US008888226B1

(12) United States Patent
Gardner et al.

(10) Patent No.: US 8,888,226 B1
(45) Date of Patent: Nov. 18, 2014

(54) CRACK DETECTION CIRCUITS FOR PRINTHEADS

(71) Applicant: Hewlett-Packard Development Company, L.P., Houston, TX (US)

(72) Inventors: James M. Gardner, Corvallis, OR (US); Chris Bakker, Corvallis, OR (US); Eric T. Martin, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/926,171

(22) Filed: Jun. 25, 2013

(51) Int. Cl.
*B41J 29/393* (2006.01)
*B41J 29/38* (2006.01)

(52) U.S. Cl.
CPC ..... *B41J 29/38* (2013.01)
USPC ..... 347/19; 324/525

(58) Field of Classification Search
USPC ..... 347/19; 324/522, 525, 718
See application file for complete search history.

(56) References Cited

U.S. PATENT DOCUMENTS 5,942,900 A 8/1999 DeMeerleer et al.
6,378,978 B1 * 4/2002 Chang et al. ..... 347/19
7,547,087 B2 * 6/2009 Cato et al. ..... 347/19
7,571,975 B2 8/2009 Lee et al.
7,598,749 B1 10/2009 Ang et al.
7,948,249 B2 5/2011 Park
2008/0035923 A1 2/2008 Tschmelitsch et al.
2009/0174426 A1 7/2009 Matoba et al.
2013/0009663 A1 1/2013 Gauch et al.

OTHER PUBLICATIONS

Dixit et al.; A Soft Computing Approach to Crack Detection and Impact Source dentification with Field-Programmable Gate Array Implementation; Hindawi Publishing Corporation; vol. 2013; Article ID 343174; pp. 1-12.
Sikora, R. et al.; The Complete Measurement System for Crack Detection and Identification; International Workshop Computational Problems of Electrical Engineering; Aug. 17, 2004; pp. 9-12.

* cited by examiner

*Primary Examiner* — Stephen Meier
*Assistant Examiner* — Sharon A Polk

(57) ABSTRACT

Crack detection circuits for printheads are described. In an example, a crack detection circuit for at least one printhead, includes: crack detectors formed on the at least one printhead; switches selectively coupling the crack detectors on each printhead to a communication bus; and a configuration circuit on each printhead coupled to control inputs of the respective switches, each configuration circuit responsive to a crack detection configuration input to control the respective switches.

15 Claims, 5 Drawing Sheets

100

CRACK DETECTION CIRCUITS FOR PRINTHEADS

BACKGROUND

Integrated circuit (IC) die, such as printhead die for ink jet printers, can be damaged during manufacture and/or use. Faults, such as cracks and fractures, can be introduced that are not readily detectable. Minor faults that are introduced during manufacture can further propagate during shipping and use, causing ICs to fail prematurely, resulting in customer dissatisfaction. The problem can be further exacerbated when multiple ICs are incorporated into a module. For example, a "page-wide" ink jet printer can include a printhead module having multiple printhead die that span the width of the media.

BRIEF DESCRIPTION OF THE DRAWINGS

Some embodiments of the invention are described with respect to the following figures.

DETAILED DESCRIPTION

Crack detection circuits for printheads are described. Example circuits described herein enable detection of cracks through all phases of the printhead manufacturing process, up to and including while the printhead is operating as installed in a printer. The crack detection circuits also enable crack detection at a print module level, where a "print module" can include multiple printhead die. The crack detection circuits can be fully contained on the printhead die, eliminating the need for additional external measurement hardware or electrical interconnect to the printhead.

In an example, a printhead or a plurality of printheads on a module can include multiple crack detectors. A crack detection circuit for at least one printhead includes crack detectors formed on each printhead. Switches on each printhead selectively couple the crack detectors to a communication bus. A configuration circuit on each printhead controls the state of the respective switches.

In another example, a plurality of printheads on a module can include at least one crack detector. At least one switch selectively couples each crack detector on each of the printheads to a communication bus on the printhead module. A configuration circuit on each of the printheads is coupled to control inputs of each respective switch.

In another example, a crack detection circuit for printhead(s) includes crack detector(s) on the printhead(s). Each printhead includes an analog-to-digital converter (ADC). Each ADC measures impedance of at least one of the crack detectors and outputs digital measurements representing the impedance.

Figure 1:
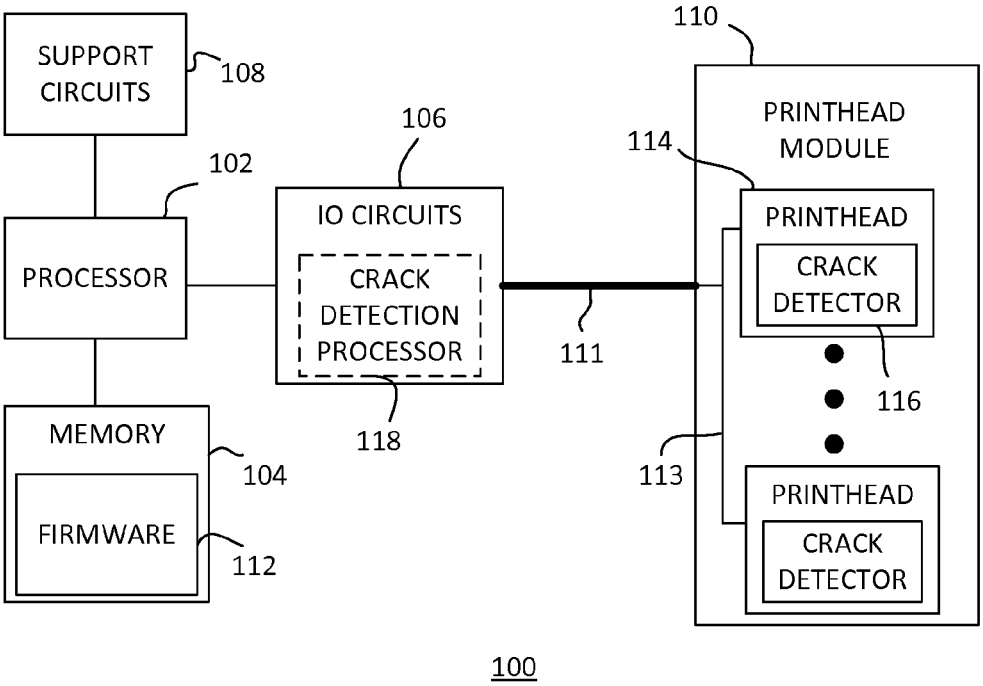
FIG. 1 is a block diagram of a printer according to an example implementation.

FIG. 1 is a block diagram of a printer 100 according to an example implementation. The printer 100 includes a processor 102, memory 104, input/output (IO) circuits 106, support circuits 108, and a printhead module 110. The processor 102 can include any type of microprocessor known in the art. The support circuits 108 can include cache, power supplies, clock circuits, data registers, and the like. The memory 104 can include random access memory, read only memory, cache memory, magnetic read/write memory, or the like or any combination of such memory devices. The memory 104 can include firmware 112. The firmware 112 can include machine-readable instructions executable by the processor 102 to perform various functions, including communication with the printhead module 110. The IO circuits 106 can by coupled to the printhead module 110 through connection 111.

In an example, the printhead module 110 includes a plurality of printheads 114. Each of the printheads 114 comprises an integrated circuit (IC) device having a semiconductor substrate, referred to as the printhead die. Each of the printheads 114 includes a crack detector 116 formed on the printhead die for detecting cracks or similar defects. Although each of the printheads 114 is shown as having a single crack detector 116, it should be understood that the printheads 114 can include multiple crack detectors 116. For example, crack detectors 116 can be physically positioned in different areas of a printhead die to detect cracks or similar defects in such areas. Further, although a module 110 is shown as having multiple printheads 114, it should be understood that the printer 100 may include a single printhead 114. Examples described herein can provide multiple levels of addressability: fine-grain addressability in terms of addressing one or more crack detectors on a given printhead; and coarse-grain addressability in terms of addressing crack detector(s) on one or more printheads in the printer 100.

The connection 111 includes an communication bus 113 shared by each of the printheads 114. The communication bus 113 can include at least one conductor. The connection 111 can include various other shared and/or non-shared communication links. In a non-limiting example, the printhead module 110 can include at least three communication links: (1) a low-speed serial communication bus shared among the printheads 114 that can be used for die configuration; (2) a high-speed data channel for each of the printheads 114 that can be used to communicate print data to each printhead and/or used for die configuration; and (3) a global reset signal shared among the printheads 114. In such an example, the low-speed serial communication bus can be selected as the communication bus 113. It should be understood that the printhead module 110 can have other IO configurations, and the communication bus 113 can be another type of shared bus or communication link.

The printer 100 can perform crack detection at the printhead module level. The term "crack detection" is meant to include detection of various defects or mechanical damage similar to cracks. In an example, the IO circuits 106 include a crack detection processor 118. The processor 102 can execute machine-code in the firmware 112 to perform a crack detection process. The processor 102 can configure a printhead 114 to couple a crack detector 116 to the IO bus 113. The crack detection processor 118 can sense the crack detector 116 over the communication bus 113 and report measurement(s) to the processor 102. The processor 102 can then determine if the measurement(s) are indicative of a cracked printhead die. The crack detection process can then be repeated for other crack detectors 116 on the selected printhead 114, and/or for other printheads 114 on the printhead module 110.

In another example, functionality of the crack detection processor 118 is moved from the IO circuits 106 to the individual printheads 114 as part of the crack detector 116. The crack detection process can be performed as follows: The processor 102 can configure a printhead 114 to activate a crack detector 116. The crack detector 116 can return digitized measurement(s) to the IO circuits 106 over the communication bus 113. The processor 102 can then determine if the measurement(s) are indicative of a cracked printhead die. The crack detection process can then be repeated for other crack detectors 116 on the selected printhead 114, and/or for other printheads 114 on the printhead module.

Figure 2:
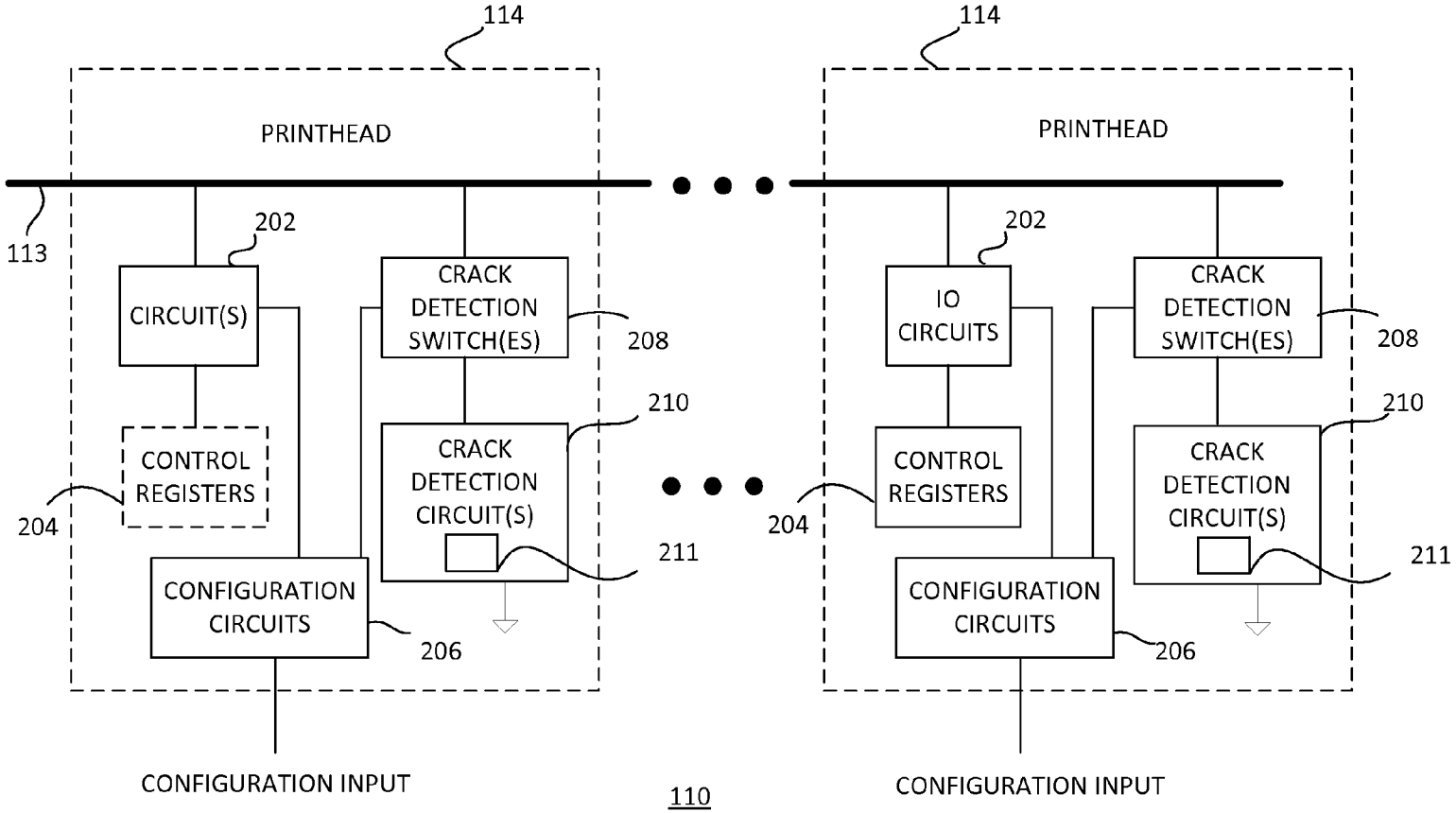
FIG. 2 is a block diagram of a portion of the printhead module according to an example implementation.

FIG. 2 is a block diagram of a portion of the printhead module 110 according to an example implementation. Elements of FIG. 2 that are the same or similar to those of FIG. 1 are designated with identical reference numerals and are described in detail above. Each of the printheads 114 includes additional circuit(s) 202, control registers 204, configuration circuits 206, crack detection switch(es) 208, and crack detection circuit(s) 210 (also referred to as crack detectors). The circuit(s) 202 are coupled to the communication bus 113. In an example, the circuit(s) 202 can read from, and write to, the control registers 204. The circuit(s) 202 can implement a digital input/output interface to the control registers 204. The control registers 204 can store data for configuring a printhead. It is to be understood that the circuit(s) 202 can include other types of circuits, including digital circuits, analog circuits, or mixed analog/digital circuits. The circuit(s) 202 may perform various functions, and may or may not be coupled to the control registers 204.

The crack detection switch(es) 208 include one or more switches also coupled to the communication bus 113. Each of the crack detection switch(es) 208 selectively couples one of the crack detection circuit(s) 210 to the communication bus 113. The crack detection circuit(s) 210 include one or more circuits that can be used to detect cracks or similar defects in the printhead die. For example, each of the crack detection circuit(s) 210 can be an impedance element 211 coupled between one of the crack detection switch(es) 208 and a reference voltage. By way of example, the reference voltage is shown as electrical ground, but the reference voltage may be any reference voltage level on the printhead. The impedance element(s) 211 can include resistance, capacitance, inductance, or any combination thereof. The impedance element(s) 211 can be formed from any type passive or active device (e.g., may be formed from an impedance of an active device, such as a diode).

The configuration circuits 206 are coupled to control inputs of each of the circuit(s) 202 and the crack detection switch(es) 208. The configuration circuits 206 control whether the circuit(s) 202 or the crack detection switch(es) 208 is/are coupled to the communication bus 113. In an example, the configuration circuits 206 can receive a configuration input on another communication link (e.g., another communication link on the connection 111).

The configuration input is used to select between the circuit(s) 202 and the crack detection switch(es) 208. If the configuration input is a crack detection configuration input, the configuration circuits 206 select the crack detection switch(es) 208 to be coupled to the communication bus 113, and disconnects the circuit(s) 202 (or otherwise isolates the circuit(s) 202) from the communication bus 113. If there are multiple crack detection switches 208, the crack detection configuration input can open or close specific ones of the switches 208. By sending the appropriate configuration inputs, crack detection measurements can be obtained from different printheads 114, and different crack detectors on any given printhead.

Figure 3:
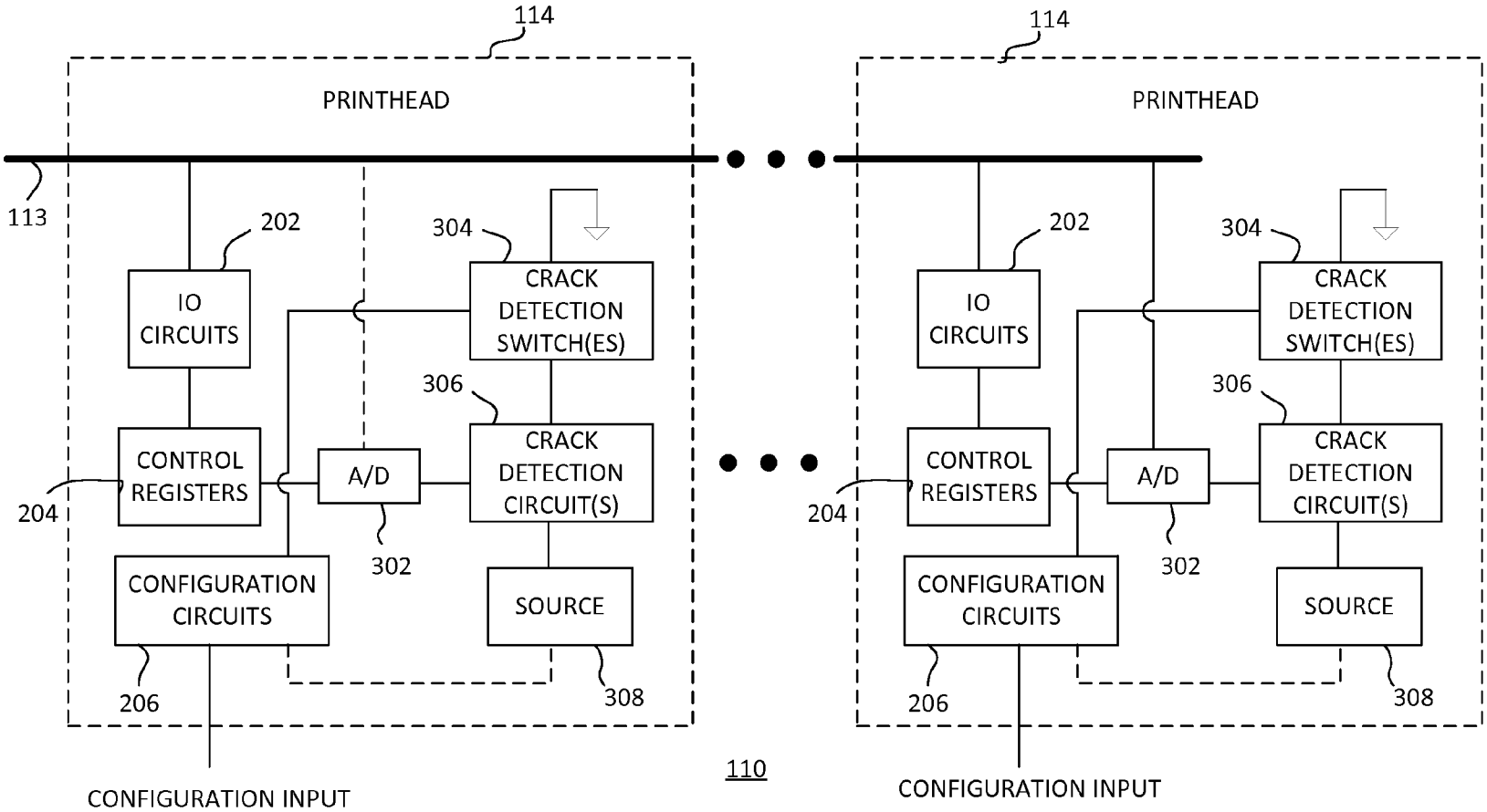
FIG. 3 is a block diagram of a portion of the printhead module according to another example implementation.

FIG. 3 is a block diagram of a portion of the printhead module 110 according to another example implementation. Elements of FIG. 3 that are the same are similar to those of FIGS. 1 and 2 are designated with identical reference numerals and are described in detail above. Some elements may be omitted for clarity. In this example, each of the printheads 114 includes an analog-to-digital converter (ADC) 302, crack detection switch(es) 304, crack detection circuit(s) 306 (also referred to as crack detectors), and a source 308. The configuration circuits 206 are coupled to a control input of the crack detection switch(es) 304. The crack detection switch(es) 304 selectively couple the crack detection circuit(s) 306 to a reference voltage (e.g., electrical ground) based on control provided by the configuration circuits 206.

The source 308 energizes the crack detection circuit(s) 306. The source 308 can be either a current source for driving current to the crack detection circuit(s) 306, or a voltage source for applying a potential to the crack detection circuit(s) 306. In an example, the source can be selectively enabled/disabled by the configuration circuits 206. In an example, the source 308 can be a dedicated source for the crack detection circuit(s) 306. In another example, the source 308 can be derived from other circuitry on the printhead (e.g., existing source circuitry used by the printhead for other purposes).

The ADC 302 measures voltage on at least one of the crack detection circuit(s) 306. In an example, the crack detection circuit(s) 306 each include an impedance element selectively coupled to the reference voltage by one of the crack detection switch(es) 304. When the appropriate switch is closed, the impedance element provides a conduction path to the reference voltage. If a potential is applied to the impedance element, or current driven through the impedance element, the ADC 302 can measure the current across the impedance element, or potential across the impedance element, respectively. That is, the ADC 302 measures the impedance of the impedance element when energized by a voltage or current source. The ADC 302 can digitize the measurement(s) and provide the digital measurement(s) as output. In an example, the ADC 302 can store the digital measurement data in the control registers 204. The printer (e.g., the IO circuits 106) can then obtain the digital measurements using the communication bus 113 and the circuit(s) 202. In another example, the ADC 302 can be directly coupled to the communication bus 113 and can provide the digital measurements to the printer (e.g., the IO circuits 106) through the communication bus 113.

Figure 4:
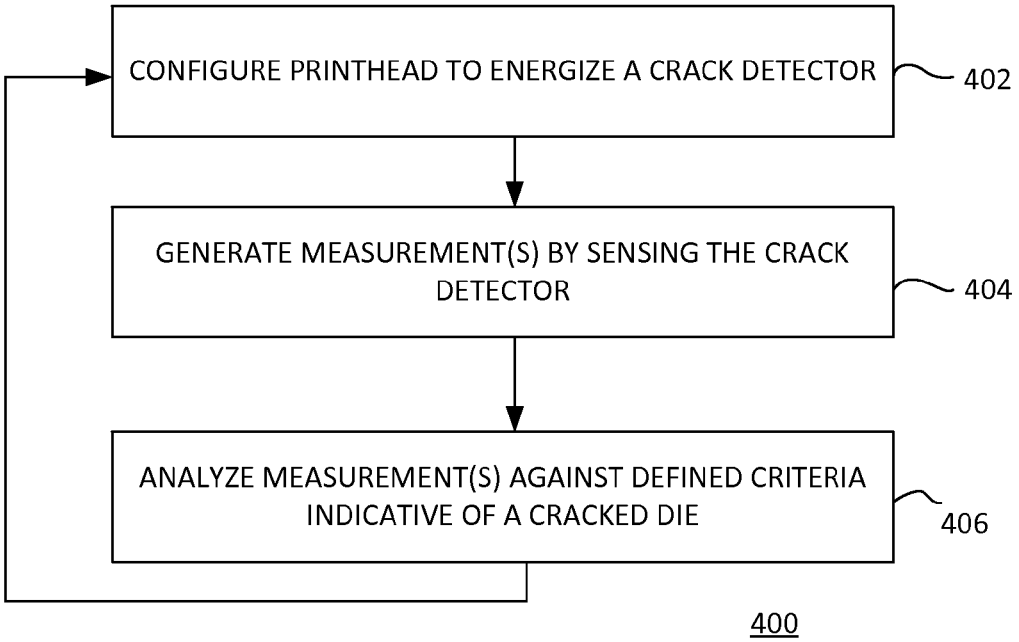
FIG. 4 is a flow diagram showing a method of detecting cracks in a printhead according to an example implementation.

FIG. 4 is a flow diagram showing a method 400 of detecting cracks in a printhead according to an example implementation. The method 400 begins at step 402, where a selected printhead of at least one printhead is configured to energize a selected crack detector of at least one crack detector. At step 404, measurement(s) are generated by sensing the selected crack detector. In an example, the measurement(s) can be obtained by sensing the selected crack detector over a communication bus. At step 406, the measurement(s) are analyzed against defined criteria indicative of a cracked die (or similar defects). The method 400 can be repeated for additional crack detectors on the printhead, and/or for additional printheads on the module.

Figure 5:
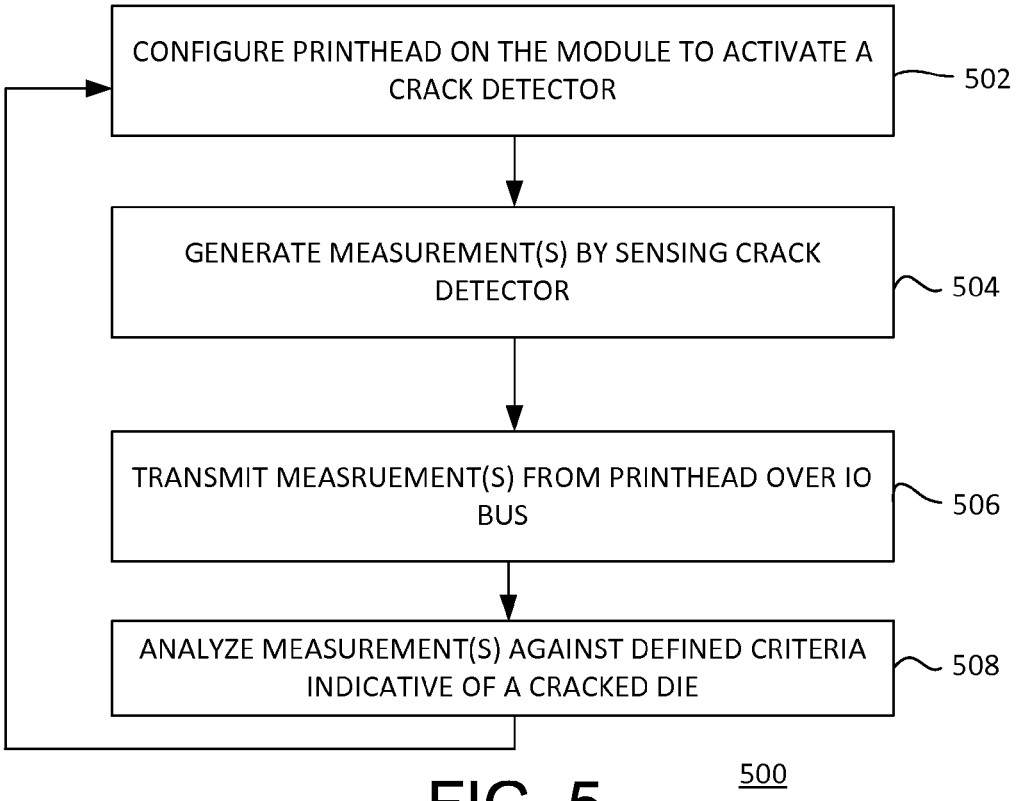
FIG. 5 is a flow diagram showing a method of detecting cracks in a printhead according to an example implementation.

FIG. 5 is a flow diagram showing a method 500 of detecting cracks in in a printhead according to an example implementation. The method 500 begins at step 502, where a selected printhead of at least one printhead is configured to activate a selected crack detector of at least one crack detector. At step 504, measurement(s) are generated by sensing the selected crack detector. In an example, the measurement(s) can be generated by an ADC coupled to the selected crack detector. At step 506, the measurement(s) are transmitted from the printhead over a communication bus. At step 508, the measurement(s) are analyzed against defined criteria indicative of a cracked die (or similar defects). The method 500 can be repeated for additional crack detectors on the printhead, and/or for additional printheads on the module.

Figure 6:
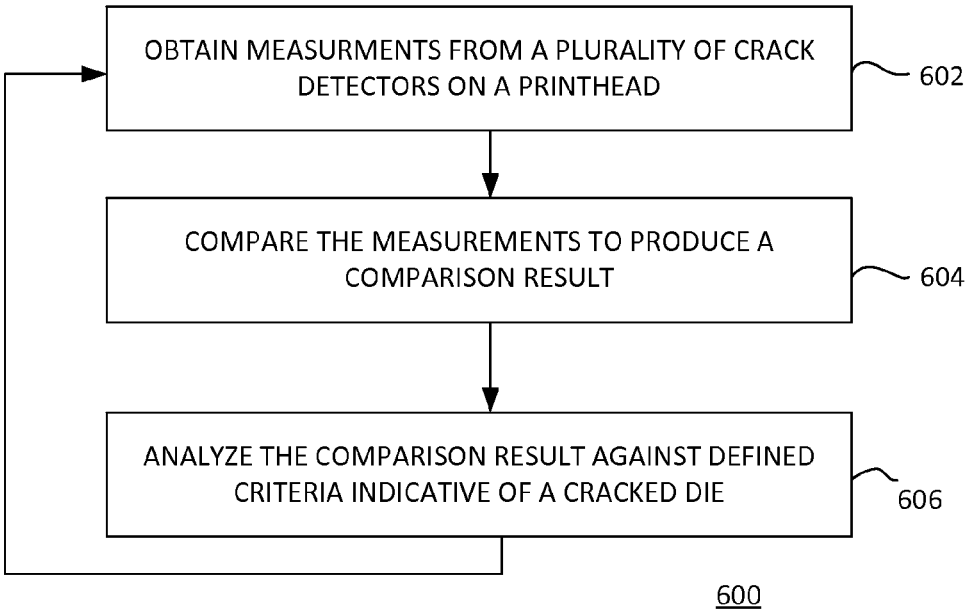
FIG. 6 is a flow diagram showing a method of detecting cracks in a printhead according to an example implementation.

FIG. 6 is a flow diagram showing a method 600 of detecting cracks in a printhead according to an example implementation. The method 600 begins at step 602, where measurements are obtained from a plurality of crack detectors on a printhead. The measurements can be obtained using techniques of either the method 400 of FIG. 4 or the method 500 of FIG. 5. At step 604, the measurements are compared to produce a comparison result. For example, if measurements are obtained from two different crack detectors on a printhead, a difference between the measurements can be computed as the comparison result (e.g., a delta). At step 606, the comparison result is analyzed against defined criteria indicative of a cracked die (or similar defects). The method 600 can be repeated for additional crack detectors on the printhead, and/or additional printheads on the module.

Crack detection circuits for printheads have been described. The crack detection circuits allow for crack detection at all stages of the printhead manufacturing process, including post printhead installation into a printer and throughout product life. The crack detection circuits allow for crack detection measurements to be performed with on-die printhead circuitry at minimal or no additional cost, rather than requiring dedicated system-level hardware, additional interconnects, and/or new firmware routines to perform the crack detection measurement. The crack detection circuits can communicate crack detection measurements off-die (e.g., to the printer or manufacturing tool) using pre-existing electrical connections and communication protocols. The crack detection circuits can remove system-level design constraints by performing the measurements on-die with existing communication protocols, which can be valuable for multi-die modules. The crack detection circuits allow for simple integration of various types of crack detect sensors through reticle mask revisions and allow for multiple sensors per die. In examples, the crack detection circuits use signals that are available at all stages of the manufacturing process.

In the foregoing description, numerous details are set forth to provide an understanding of the present invention. However, it will be understood by those skilled in the art that the present invention may be practiced without these details. While the invention has been disclosed with respect to a limited number of embodiments, those skilled in the art will appreciate numerous modifications and variations therefrom. It is intended that the appended claims cover such modifications and variations as fall within the true spirit and scope of the invention.

What is claimed is:

1. A crack detection circuit for at least one printhead, comprising:

crack detectors formed on the at least one printhead;

switches selectively coupling the crack detectors on each printhead to a communication bus; and a configuration circuit on each printhead coupled to control inputs of the respective switches, each configuration circuit responsive to a crack detection configuration input to control the respective switches.

2. The crack detection circuit of claim 1, wherein the communication bus is coupled to at least one additional circuit on each printhead, and wherein the crack detection configuration input isolates the communication bus from each additional circuit.

3. The crack detection circuit of claim 1, wherein each of the crack detectors includes an impedance element coupled between a respective one of the switches and a reference voltage.

4. A crack detection circuit for a printhead module having a plurality of printheads, comprising:

at least one crack detector formed on each of the plurality of printheads;

at least one switch selectively coupling each crack detector on each of the plurality of printheads to a communication bus on the printhead module;

a configuration circuit on each of the plurality of printheads coupled to control inputs of each respective switch, the configuration circuit responsive to a crack detection configuration input to control each respective switch.

5. The crack detection circuit of claim 4, wherein the communication bus is coupled to at least one additional circuit on each of the plurality of printheads, and wherein the crack detection configuration input isolates the communication bus from each additional circuit.

6. The crack detection circuit of claim 4, wherein each crack detector includes an impedance element coupled between each switch and a reference voltage.

7. A crack detection circuit for at least one printhead, comprising:

at least one crack detector formed on the at least one printhead;

an analog-to-digital converter (ADC) on each printhead, each ADC configurable to measure impedance of each respective crack detector and output digital measurements representing the impedance.

8. The crack detection circuit of claim 7, wherein each crack detector comprises:

at least one conduction path providing impedance to a reference voltage;

at least one switch selectively coupling the at least one conduction path to a current source or voltage source.

9. The crack detection circuit of claim 8, further comprising an enable input to selectively configure the current source or the voltage source to energize each conduction path.

10. The crack detection circuit of claim 7, wherein each ADC is coupled to a memory configured to store the digital measurements.

11. The crack detection circuit of claim 7, wherein each ADC couples the digital measurements to a communication bus.

12. A method of detecting cracks on at least one printhead, comprising:

configuring a selected printhead of the at least one printhead to energize a selected crack detector of a plurality of crack detectors;

generating at least one measurement by sensing the selected crack detector;

analyzing the at least one measurement against defined criteria indicative of a cracked die; and repeating the steps of configuring, generating, and analyzing for at least one additional selected crack detector of the plurality of crack detectors.

13. The method of claim 12, wherein the at least one printhead comprises a plurality of printheads, and wherein the step of repeating is performed for at least one additional selected printhead of the plurality of printheads.

14. The method of claim 12, wherein the step of configuring includes coupling the selected crack detector to a communication bus, and wherein the step of generating includes sensing the selected crack detector over the communication bus.

15. The method of claim 12, further comprising:

transmitting the at least one measurement from the selected printhead over a communication bus.

* * * * *